US009359825B2

(12) United States Patent
Gavia et al.

(10) Patent No.: US 9,359,825 B2
(45) Date of Patent: Jun. 7, 2016

(54) CUTTING ELEMENT PLACEMENT ON A FIXED CUTTER DRILL BIT TO REDUCE DIAMOND TABLE FRACTURE

(75) Inventors: David Gavia, The Woodlands, TX (US); Floyd C. Felderhoff, Montgomery, TX (US); Matthew R. Isbell, Houston, TX (US); Michael L. Doster, Spring, TX (US)

(73) Assignee: Baker Hughes Incorporated, Houston, TX (US)

( * ) Notice: Subject to any disclaimer, the term of this patent is extended or adjusted under 35 U.S.C. 154(b) by 1204 days.

(21) Appl. No.: 12/537,899

(22) Filed: Aug. 7, 2009

(65) Prior Publication Data

US 2011/0031029 A1 Feb. 10, 2011
US 2012/0234608 A9 Sep. 20, 2012

Related U.S. Application Data

(63) Continuation-in-part of application No. 11/862,440, filed on Sep. 27, 2007, now Pat. No. 7,896,106.

(60) Provisional application No. 60/873,349, filed on Dec. 7, 2006.

(51) Int. Cl.
*E21B 10/55* (2006.01)
*E21B 10/43* (2006.01)

(52) U.S. Cl.
CPC *E21B 10/43* (2013.01); *E21B 10/55* (2013.01)

(58) Field of Classification Search
CPC ..... E21B 10/43; E21B 10/55; E21B 10/602
USPC ..... 175/431
See application file for complete search history.

(56) References Cited

U.S. PATENT DOCUMENTS

| | | | | |
|---|---|---|---|---|
| 3,140,748 | A | 7/1964 | Engle et al. | |
| 3,709,308 | A * | 1/1973 | Rowley et al. | 175/434 |
| 4,200,159 | A * | 4/1980 | Peschel et al. | 175/428 |
| 4,350,215 | A * | 9/1982 | Radtke | 175/433 |
| 4,602,691 | A * | 7/1986 | Weaver | 175/430 |
| 4,804,049 | A * | 2/1989 | Barr | 175/428 |
| 5,115,873 | A * | 5/1992 | Pastusek | 175/65 |
| 5,441,121 | A | 8/1995 | Tibbitts | |
| 6,123,161 | A * | 9/2000 | Taylor | 175/397 |
| 6,241,036 | B1 | 6/2001 | Lovato et al. | |
| 6,527,065 | B1 | 3/2003 | Tibbitts et al. | |
| 6,742,611 | B1 | 6/2004 | Illerhaus et al. | |
| 6,883,623 | B2 * | 4/2005 | McCormick et al. | 175/408 |

(Continued)

OTHER PUBLICATIONS

International Search Report for International Application No. PCT/US2010/044344 mailed Feb. 25, 2011, 3 pages.

(Continued)

*Primary Examiner* — Blake Michener
*Assistant Examiner* — Kipp Wallace
(74) *Attorney, Agent, or Firm* — TraskBritt

(57) ABSTRACT

A rotary drag bit includes a primary cutter row comprising at least one primary cutter mounted on a blade, at least some cutters in the primary cutter row having a portion of a cutting surface thereof covered by a portion of the blade. A backup cutter row comprising at least one cutter may also be included, and at least a portion of a cutting surface of at least some cutters in the backup cutter row is covered by a portion of the blade. Enhanced support for cutters is provided against impact loading.

25 Claims, 7 Drawing Sheets

(56) References Cited

U.S. PATENT DOCUMENTS

| | | | | |
|---|---|---|---|---|
| 7,178,609 | B2 * | 2/2007 | Hart et al. | 175/61 |
| 7,597,159 | B2 | 10/2009 | Overstreet | |
| 2005/0089440 | A1 * | 4/2005 | Kembaiyan | 420/502 |
| 2006/0070771 | A1 * | 4/2006 | McClain et al. | 175/57 |
| 2008/0105466 | A1 | 5/2008 | Hoffmaster et al. | |
| 2008/0135297 | A1 | 6/2008 | Gavia | |
| 2008/0179108 | A1 | 7/2008 | McClain et al. | |
| 2008/0230278 | A9 * | 9/2008 | Hoffmaster et al. | 175/408 |
| 2008/0302575 | A1 | 12/2008 | Durairajan et al. | |
| 2009/0266619 | A1 * | 10/2009 | Durairajan et al. | 175/431 |

OTHER PUBLICATIONS

International Written Opinion for International Application No. PCT/US2010/044344 mailed Feb. 25, 2011, 3 pages.

International Preliminary Report on Patentability for International Application No. PCT/US2010/044344 dated Feb. 7, 2012, 5 pages.

* cited by examiner

CUTTING ELEMENT PLACEMENT ON A FIXED CUTTER DRILL BIT TO REDUCE DIAMOND TABLE FRACTURE

CROSS-REFERENCE TO RELATED APPLICATIONS

This application is a continuation-in-part of U.S. patent application Ser. No. 11/862,440, filed Sep. 27, 2007, now U.S. Pat. No. 7,896,106, issued Mar. 1, 2011, to Gavia, which claims the benefit of the filing date of U.S. Provisional Patent Application Ser. No. 60/873,349, filed Dec. 7, 2006, for "ROTARY DRAG BITS HAVING A PILOT CUTTER CONFIGURATION AND METHOD TO PREFRACTURE SUBTERRANEAN FORMATIONS THEREWITH."

TECHNICAL FIELD

The present invention, in several embodiments, relates generally to a rotary drag bit for drilling subterranean formations and, more particularly, to rotary drag bits having cutters placed to enhance cutter life and performance.

BACKGROUND

Rotary drag bits have been use for subterranean drilling for many decades, and various sizes, shapes and patterns of natural and synthetic diamonds have been used on drag bit crowns as cutting elements. A drag bit can provide an improved rate of penetration (ROP) over a tri-cone bit in many formations.

Over the past few decades, rotary drag bit performance has been improved with the use of a polycrystalline diamond compact (PDC) cutting element or cutter, comprising a planar diamond cutting element or table formed onto a tungsten carbide substrate under high temperature and high pressure conditions. The PDC cutters are formed into a myriad of shapes including circular, semicircular or tombstone, which are the most commonly used configurations. Typically, the PDC diamond tables are formed so the edges of the table are coplanar with the supporting tungsten carbide substrate or the table may overhang or be undercut slightly, forming a "lip" at the trailing edge of the table in order to improve the cutting effectiveness and wear life of the cutter as it comes into formations being drilled. Bits carrying PDC cutters, which for example, may be brazed into pockets in the bit face, pockets in blades extending from the face, or mounted to studs inserted into the bit body, have proven very effective in achieving an ROP in drilling subterranean formations exhibiting low to medium compressive strengths. The PDC cutters have provided drill bit designers with a wide variety of improved cutter deployments and orientations, crown configurations, nozzle placements and other design alternatives previously not possible with the use of small natural diamond or synthetic diamond cutters. While the PDC cutting element improves drill bit efficiency in drilling many subterranean formations, the PDC cutting element is nonetheless prone to wear and damage when exposed to certain drilling conditions, resulting in a shortened life of a rotary drag bit using such cutting elements.

Thermally stable diamond (TSP) is another type of synthetic diamond, PDC material which can be used as a cutting element or cutter for a rotary drag bit. TSP cutters, which have had catalyst used to promote formation of diamond-to-diamond bonds in the structure removed therefrom, have improved thermal performance over PDC cutters. The high frictional heating associated with hard and abrasive rock drilling applications creates cutting edge temperatures that exceed the thermal stability of PDC whereas TSP cutters remain stable at higher operating temperatures. This characteristic also enables them to be furnaced into the face of a matrix-type rotary drag bit.

While the PDC or TSP cutting elements provide better ROP and manifest less wear during drilling as compared to some other cutting element types, it is still desirable to further the life of rotary drag bits and improve cutter life regardless of the cutter type used. Either type of PDC cutting element is generally fixedly mounted to a rotary drill bit that cuts the formation substantially in a shearing action through rotation of the bit and application of drill string weight thereto. A plurality of either, or even both, types of PDC cutting elements is mounted on a given bit, and cutting elements of various sizes may be employed on the same bit.

Drill bit bodies may be cast and/or machined from metal, typically steel, or may be formed of a powder metal infiltrated with a liquid binder at high temperatures to form a matrix-type bit body. PDC cutting elements may be brazed to a matrix-type bit body after furnacing, or TSPs may even be bonded into the bit body during the furnacing process used for infiltration. Cutting elements are typically secured to cast or machined (steel body) bits by preliminary bonding to a carrier element, commonly referred to as a stud, which in turn is inserted into an aperture in the face of the bit body and mechanically or metallurgically secured thereto. Studs are also employed with matrix-type bits, as are cutting elements secured via their substrates to cylindrical carrier elements affixed to the matrix-type bit body.

It has long been recognized that PDC cutting elements, regardless of their method of attachment to drag bits, experience relatively rapid degradation in use due to the extreme temperatures and high loads, particularly impact loading, during drilling. One of the major observable manifestations of such degradation is the fracture or spalling of the PDC cutting element cutting edge, wherein large portions of the superabrasive PDC layer separate from the cutting element. The spalling may spread down the cutting face of the PDC cutting element, and even result in delamination of the superabrasive layer from the backing layer of substrate, or from the bit itself if no substrate is employed. At the least, cutting efficiency is reduced by cutting edge damage, which also reduces the rate of penetration of the drag bit into the formation. Even minimal fracture damage can have a negative effect on cutter life and performance. Once the sharp corner on the leading edge (taken in the direction of cutter movement) of the diamond table is chipped, the amount of damage to the table continually increases, as does the normal force required to achieve a given depth of cut. Therefore, as damage to the cutting edge and cutting face occurs and the rate of penetration of the drag bit decreases, the conventional rig-floor response of increasing weight on bit quickly leads to further degradation and ultimately catastrophic failure of the chipped cutting element.

While continuing to develop and seek out improvements for longer lasting cutters and improvements to cutter performance, it would be desirable to utilize or take advantage of the nature of cutting element damage in extending or improving the life of the drag bit by reducing cutting element damage due to impact loading.

One approach to enhancing bit life is to use the so-called "backup" cutter to extend the life of a primary cutter of the drag bit particularly when subjected to dysfunctional energy or harder, more abrasive, material in the subterranean formation. Conventionally, the backup cutter is positioned in a second cutter row, rotationally following in the path of a primary cutter, so as to engage the formation should the primary cutter fail or wear beyond an appreciable amount. The use of backup cutters has proven to be a convenient technique for extending the life of a bit, while enhancing stability without the necessity of designing the bit with additional blades to carry more cutters which might potentially comprise bit hydraulics due to reduced available fluid flow area over the bit face and less-than-optimum fluid flow due to unfavorable placement of nozzles in the bit face. Durability may be quantified in terms of cutter placement, and in terms of the ability to maintain the sharpness of each cutter for a longer period of time while drilling. In this sense, "sharpness" of each cutter involves improving wear of the diamond table, including less fracturing, chipping or damage to the diamond table caused by point loading, dysfunctional energy, or drill string bounce.

Accordingly, there is an ongoing desire to improve or extend rotary drag bit life and performance in any type of subterranean formation type being drilled. There is a further desire to extend the life of a rotary drag bit by beneficially orienting and positioning cutters upon the bit body to have greater support of the rotary drag bit to protect the cutting element from excessive impact and torsional loading to prevent fracturing and chipping of the cutting element.

BRIEF SUMMARY

Rotary drill bits having structure providing enhanced support for cutting elements disposed thereon.

The advantages and features of the embodiments herein will become apparent when viewed in light of the detailed description of the various embodiments of the invention when taken in conjunction with the attached drawings and appended claims.

DETAILED DESCRIPTION

Figure 1:
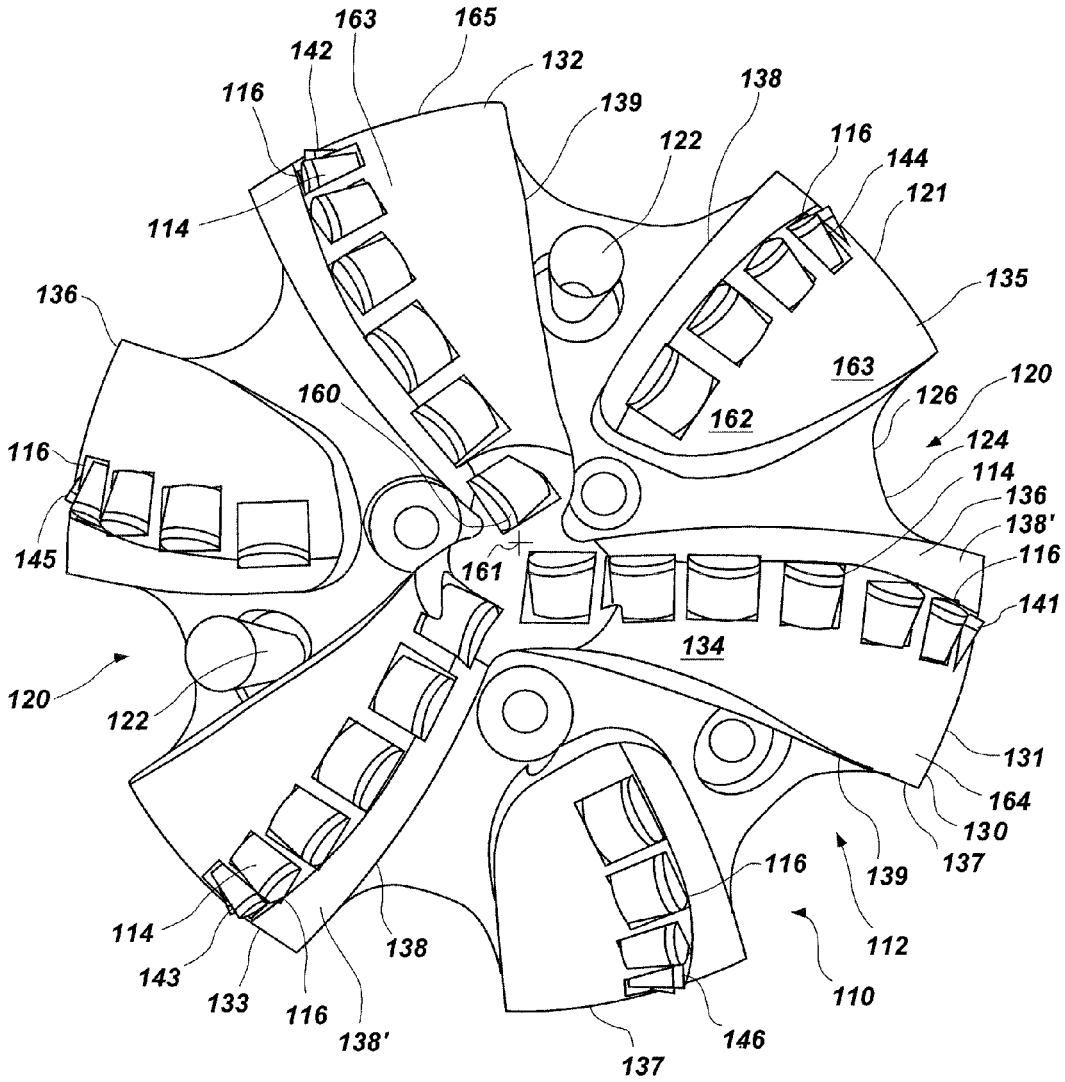
FIG. 1 shows a frontal or face view of a rotary drag bit in accordance with an embodiment herein.

In the description which follows and in the accompanying drawings, like features and elements are designated with the same or similar reference numerals.

Illustrated in FIG. 1 is a frontal or face view of an embodiment of a rotary drag bit 110. The rotary drag bit 110 comprises three primary blades 131, 132, 133 having three primary cutter rows 141, 142, 143 thereon, each row having PDC cutting elements or cutters 114 comprising a diamond table on a substrate secured in pockets 116 in primary blades 131, 132, 133 and three secondary blades 135, 136, 137 having three primary cutter rows 144, 145, 146 therein, each having PDC cutting elements or cutters 114 comprising a diamond table on a substrate secured in pockets 116 in secondary blades 135, 136, 137. The rotary drag bit 110, as depicted, is as viewed by looking upwardly at its face or leading end 112 as if the viewer were positioned at the bottom of a bore hole. The plurality of PDC cutting elements or cutters 114 are bonded to rotary drag bit 110, as by brazing, having a portion of the cutting elements 114 extending into pockets 116 (as representatively shown) located in the blades 131, 132, 133, 135, 136, 137 and another portion of cutting elements 114 extending above the face 112 of the drag bit 110. Other cutter attachment techniques may be used as is well known to those of ordinary skill in the art. The drag bit 110 in this embodiment is a so-called "matrix" body bit. Optionally, the bit may also be a steel body or other bit type, such as a sintered metal carbide body. "Matrix" bits include a mass of metal powder, such as tungsten carbide particles, infiltrated with a molten, subsequently hardenable binder, such as a copper-based alloy. Steel bits are generally made from a forging or billet and machined to a final shape. The invention is not limited by the type of bit body employed for implementation of any embodiment thereof.

Fluid courses 120 lie between blades 131, 132, 133, 135, 136, 137 and are provided with drilling fluid by ports 122 being at the end of passages leading from a plenum extending into a bit body from a tubular shank at the upper, or trailing, end of the bit 110. The ports 122 (some shown with fluid flow emanating therefrom) may include nozzles (not shown) secured thereto for enhancing and controlling flow of the drilling fluid. Fluid courses 120 extend to junk slots 126 extending upwardly along longitudinal side 124 of bit 110 between blades 131, 132, 133, 135, 136, 137. Gage pads (not shown) comprise longitudinally upward extensions of blades 131, 132, 133, 135, 136, 137 and may have wear-resistant inserts or coatings on radially outer surfaces 121 thereof as known in the art. Formation cuttings are swept away from the cutters 114 by drilling fluid emanating from ports 122, which moves generally radially outwardly through fluid courses 120 and then upwardly through junk slots 126 to an annulus between the drill string from which the bit 110 is suspended and supported. The drilling fluid provides cooling to the cutters 114 during drilling and clears formation cuttings from the bit face 112.

While each of the depicted cutters 114 are PDC cutters, it is recognized that any other suitable type of cutting element may be utilized with the invention. For clarity of the invention, the cutters 114 are shown as unitary structures in order to better describe and present the invention. However, it is recognized that the cutters 114 may comprise layers of materials. In this regard, the PDC cutters 114 of the invention each comprise a PDC diamond table bonded to a supporting substrate, as previously described. The PDC cutters 114 remove material from the underlying subterranean formation by a shearing action as the drag bit 110 is rotated by contacting the formation with cutting 113 edges of the cutters 114. As the formation is cut, the flow of drilling fluid comminutes the formation cuttings and suspends and carries the particulate mix away through the junk slots 126 mentioned above.

The blades 131, 132, 133 are each considered to be primary blades while blades 135, 136, 137 are considered to be the secondary blades on the bit 110. The blade 131, as with blades 132, 133, in general terms of a primary blade, includes a body portion 134 that extends (longitudinally and radially projects) from the face 112 and is part of the bit body (the bit body may also be characterized as the "frame" of the bit 110). The body portion 134 includes a blade surface 130, a leading face 138 and a trailing face 139 and may extend radially outward from either a cone region 160 or an axial center line C/L (shown by numeral 161) of the bit 110 toward a gage region 165 generally requiring flow of drilling fluid emanating from the adjacent preceding ports 122 to be substantially transported by way of the fluid courses 120 to the junk slots 126 by the leading face 138 during drilling. However, a portion of the drilling fluid will wash across the leading face 138 and the trailing face 139 allowing the cutters 114 to be cooled and cleaned as the material of a formation is removed. The blade 131 may also be defined by the body portion 134 extending from the face 112 of bit body 111 and extending to the gage region 165 having junk slots 126 immediately preceding the leading face 138 and following the trailing face 139. In this regard, while the bit 110 includes three primary blades 131, 132 and 133, a bit may have any number of blades, but generally will have no less than two blades separated by at least two fluid courses 120. As the body portion 134 of the blade 132 radially extends outwardly from the axial center line 161 of the bit 110, the blade surface may radially widen, and the leading face 138 and the trailing face 139 may both axially increase in height above the face 112 of the bit body 111.

As previously stated, the drag bit 110 of the invention includes three primary blades 131, 132, 133 and three secondary or tertiary blades 135, 136, 137. The secondary blades or tertiary blades 135, 136, 137 provide additional support structure in order to increase the cutter density of the bit 110 by receiving additional primary cutters 114 thereon. A secondary or a tertiary blade is defined much like a primary blade, but radially extends toward the gage region generally from a nose region 162, a flank region 163 or a shoulder region 164 of the bit 110. In this regard, the secondary blades or tertiary blades 135, 136, 137 are defined between leading and trailing fluid courses 120 in fluid communication with at least one of the ports 122. Also, a secondary blade or a tertiary blade, or a combination of secondary and tertiary blades may be provided between primary blades. However, the presence of secondary or tertiary blades decreases the available volume of the adjacent fluid courses 120, providing less clearing action of the formation cuttings or cleaning of the cutters 114. Optionally, a drag bit 110 in accordance with an embodiment of the invention may include one or more secondary or tertiary blades when needed or desired to implement particular drilling characteristics of the drag bit 110.

As illustrated, each cutter 114 is supported by a blade 131, 132, 133, 135, 136, 137 in which it is located having a portion of the leading faces 138 of the blades 131, 132, 133, 135, 136, 137 covering a portion of the cutter 114 to reduce impact loading thereon to reduce fracturing, cracking, spalling, breaking, etc., of the PDC portion of the cutter 114 as well as the backup thereto during drilling. By recessing a portion of the cutter 114 in the pocket 116, both a portion of the front and the back as well as the sides of a cutter 114 is supported by a blade 131, 132, 133, 135, 136, 137. The cutters 114 are located in pockets 116 in the blades 131, 132, 133, 135, 136, 137 aft of the leading faces 138 of the blades 131, 132, 133, 135, 136, 137 so that the cutters 114 have improved durability (lack of breakage) from vibration damage during drilling, loss of the cutter 114 caused by hydraulic fluid erosion in and around the cutter pocket 116 or body of the drag bit 110 adjacent the cutter pocket 116, and better cuttings removal from the cutter 114 across the drag bit 110 into a junk slot 126. A cutter 114 is recessed in a pocket 116 approximately one-half or 50% of the diameter or size of the cutter, although the cutter 114 may be recessed anywhere from 5% to 50% of the diameter or size thereof in the pocket 116, for the leading face 138 of a blade 131, 132, 133, 135, 136, 137 to support the diamond table of the PDC cutter 114 in the pocket 116 to reduce fracturing, cracking, spalling, breaking, etc., of the PDC portion of the cutter 114 as well as the substrate thereof during drilling. More specifically, cutters 114 may at least have about 5% to about 50% of their respective cutting surfaces covered by material of the blade to which they are respectively secured. Further, due to the use of cutter backrake, a rotationally trailing portion of a cutter 114 may be more completely recessed within a cutter pocket 116 in a blade 131, 132, 133, 135, 136, 137 than a rotationally leading portion of the cutter 114 and, further, the sides of a cutter may be recessed within a cutter pocket 116 to different depths. Finally, it may be said that a cutter 114 is substantially completely surrounded by material of a blade 131, 132, 133, 135, 136, 137 when recessed in a cutter pocket 116 according to embodiments of the present invention.

Figure 2:
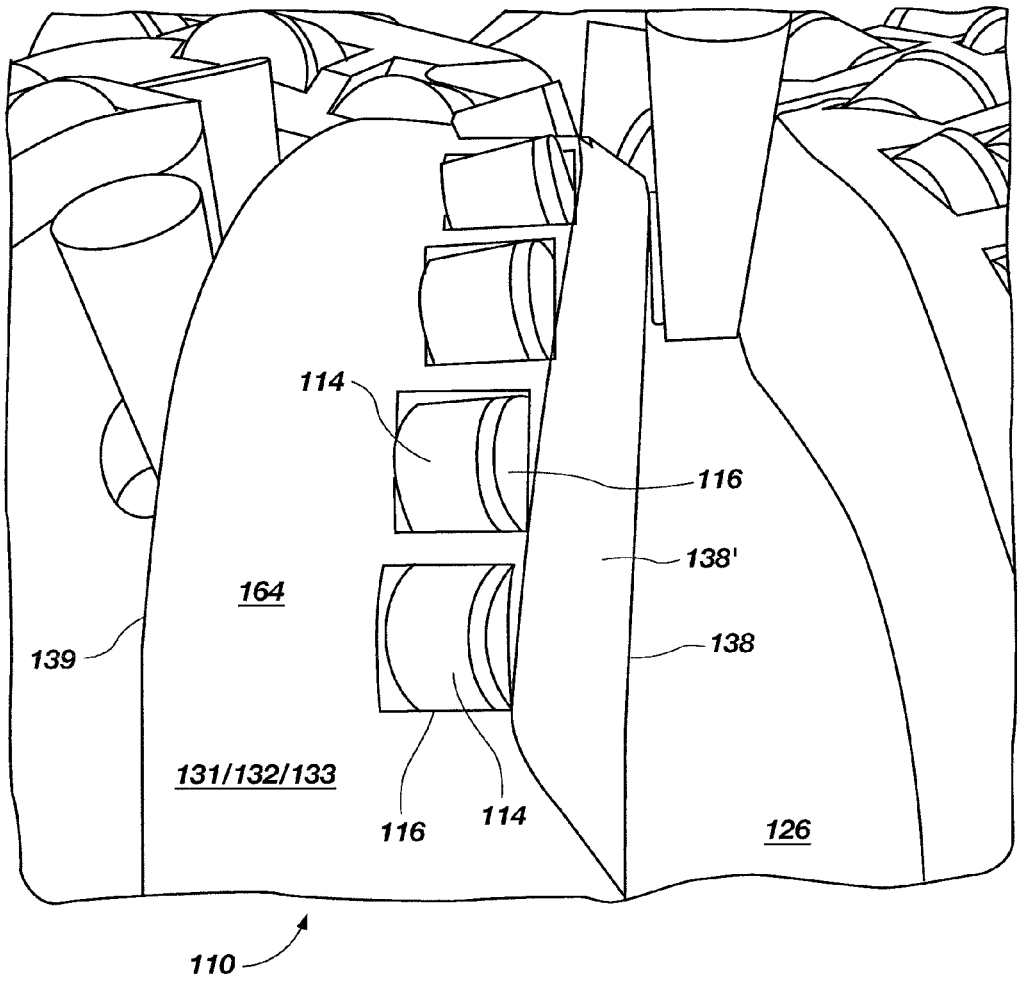
FIG. 2 shows a portion of a blade of the rotary drag bit of the embodiment herein of FIG. 1.

Illustrated in FIG. 2 is a portion of a primary blade 131, 132, 133 having cutters 114 located in pockets 116 of the blade. The leading face 138 of the blade 131, 132, 133 includes a chamfered or angular portion 138' extending back from the vertical portion of the leading face 138. As illustrated, the pockets 116 are located aft of the leading face 138 so that a portion of the blade 131, 132, 133 provides support for the front of the cutter 114 as described herein. Since the cutters 114 are secured in the pockets 116 by brazing, any space between the front, back, and sides of a cutter 114 and the walls forming the pocket 116 are filled with braze material to provide support for the cutter 114 in the pocket 116. While the cutters 114 have been illustrated having a backrake, the cutters 114 may have no backrake, a forward, or a backrake depending upon the design of the drag bit 110. The width of a blade 131, 132, 133, 135, 136, 137 of a drag bit 110 will vary so that the cutters 114 located in pockets 116 may be adequately supported on all sides in the drag bit 110.

Figure 3:
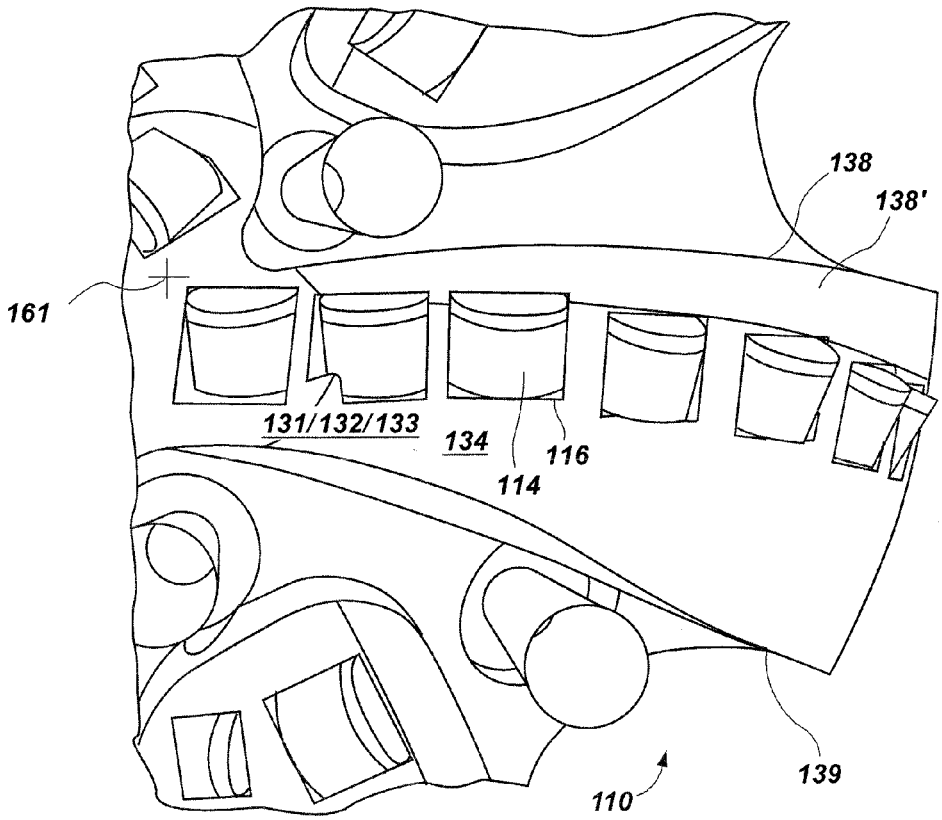
FIG. 3 shows a frontal or face view of a portion of a blade of the rotary drag bit of the embodiment of FIG. 1.

Illustrated in FIG. 3 is a frontal or face view of a portion of rotary drag bit 110. Primary blades 131, 132, 133 may include cutters 114 in primary rows 141, 142, 143 (see FIG. 1) located in pockets 116 therein as well as cutters 114 located in pockets 116 located in backup rows thereon (see, e.g., FIG. 4). As illustrated, braze used to secure the cutters 114 in the pockets 116 is not shown for clarity. A suitable braze used to secure the cutters 114 in the pockets 116 is described in U.S. patent application Ser. No. 11/223,215, filed on Sep. 9, 2005, now U.S. Pat. No. 7,597,159, issued Oct. 6, 2009, the disclosure of which is incorporated in its entirety herein by reference.

Figure 4:
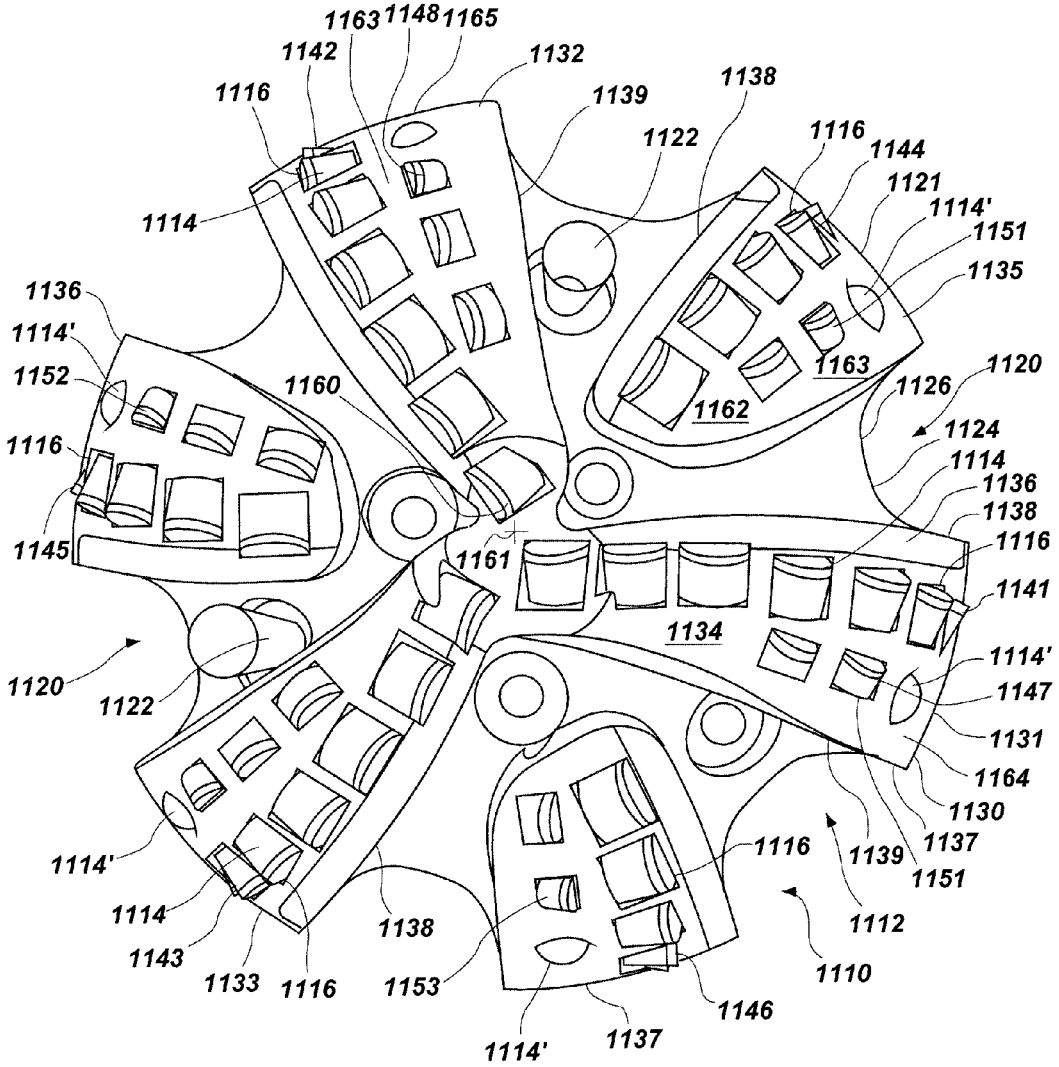
FIG. 4 shows a frontal or face view of another embodiment of a rotary drag bit herein.

Illustrated in FIG. 4 is a frontal or face view of another embodiment of a rotary drag bit 1110. The rotary drag bit 1110 comprises three primary blades 1131, 1132, 1133 respectively having primary cutter rows 1141, 1142, 1143 thereon, each row having PDC cutting elements 1114 including a substrate and a diamond table secured thereto located in pockets 1116 in primary blades 1131, 1132, 1133 and three secondary blades 1135, 1136, 1137 having three primary cutter rows 1144, 1145, 1146 therein, each having PDC cutting elements 1114 including a substrate and a diamond table secured thereto located in pockets 1116 in secondary blades 1135, 1136, 1137. The primary blades 1131, 1132, 1133, also include backup cutter rows 1147, 1148, 1149 having cutting elements 1114 in pockets 1116 while secondary blades 1135, 1136, 1137 include backup cutter rows 1151, 1152, 1153 having cutting elements 1114 located in pockets 1116 therein.

The rotary drag bit 1110, as depicted, is as viewed by looking upwardly at its face or leading end 1112 as if the viewer were positioned at the bottom of a bore hole. Bit 1110 includes a plurality of cutting elements or cutters 1114 bonded, as by brazing, having a portion of the cutting elements 1114 extending into pockets 1116 (as representatively shown) located in the blades 1131, 1132, 1133, 1135, 1136, 1137 and another portion of cutting elements 1114 extending above the face 1112 of the drag bit 1110. While the cutters 1114 are bonded to the pockets 1116 by brazing, other attachment techniques may be used as is well known to those of ordinary skill in the art. The drag bit 1110 in this embodiment is a so-called "matrix" body bit. Optionally, a bit may also be a steel body or other bit type, such as a sintered metal carbide body. "Matrix" bits include a mass of metal powder, such as tungsten carbide particles, infiltrated with a molten, subsequently hardenable binder, such as a copper-based alloy. Steel bits are generally made from a forging or billet and machined to a final shape. The invention is not limited by the type of bit body employed for implementation of any embodiment thereof.

Fluid courses 1120 lie between blades 1131, 1132, 1133, 1135, 1136, 1137 and are provided with drilling fluid by ports 1122 being at the end of passages leading from a plenum extending into a bit body from a tubular shank at the upper, or trailing, end of the bit 1110. The ports 1122 (some shown with drilling fluid emanating therefrom) may include nozzles (not shown) secured thereto for enhancing and controlling flow of the drilling fluid. Fluid courses 1120 extend to junk slots 1126 extending upwardly along the longitudinal side 1124 of bit 1110 between blades 1131, 1132, 1133, 1135, 1316, 1317. Gage pads (not shown) comprise longitudinally upward extensions of blades 1131, 1132, 1133, 1135, 1136, 1137 and may have wear-resistant inserts or coatings on radially outer surfaces 1121 thereof as known in the art. Formation cuttings are swept away from the cutters 1114 by drilling fluid (not shown) emanating from ports 1122, which moves generally radially outwardly through fluid courses 1120 and then upwardly through junk slots 1126 to an annulus between the drill string from which the bit 1110 is suspended and supported. The drilling fluid provides cooling to the cutters 1114 during drilling and clears formation cuttings from the bit face 1112.

Each of the cutters 1114 are PDC cutters. However, it is recognized that any other suitable type of cutting element may be utilized with the invention. For clarity of the invention, the cutters 1114 are shown as unitary structures in order to better describe and present the invention. However, it is recognized that the cutters 1114 may comprise layers of materials. In this regard, the PDC cutters 1114 of the invention each comprise a diamond table bonded to a supporting substrate, as previously described. The PDC cutters 1114 remove material from the underlying subterranean formation by a shearing action as the drag bit 1110 is rotated by contacting the formation with cutting edges of the cutters 1114. As the formation is cut, the flow of drilling fluid comminutes the formation cuttings and suspends and carries the particulate mix away through the junk slots 1126 mentioned above.

The blades 1131, 1132, 1133 are each considered to be primary blades while blades 1135, 1136, 1137 are considered the secondary blades on the bit 1110. The blade 1131, as with blades 1132, 1133, in general terms of a primary blade, includes a body portion 1134 that extends (longitudinally and radially projects) from the face 1112 and is part of the bit body (the bit body may also be termed the "frame" of the bit 1110). The body portion 1134 includes a blade surface 1130, a leading face 1138 and a trailing face 1139 and may extend radially outward from either a cone region 1160 or an axial center line C/L (shown by numeral 1161) of the bit 1110 toward a gage region 1165 generally requiring flow of drilling fluid emanating from the adjacent preceding ports 1122 to be substantially transported by way of the fluid courses 1120 to the junk slots 1126 by the leading face 1138 during drilling. However, a portion of the drilling fluid will wash across the leading face 1138 and the trailing face 1139 allowing the cutters 1114 to be cooled and cleaned as the material of a formation is removed. The blade 1131 may also be defined by the body portion 1134 extending from the face 1112 of bit body 1111 and extending to the gage region 1165 having junk slots 1126 immediately preceding the leading face 1138 and following the trailing face 1139. In this regard, while the bit 1110 includes three primary blades 1131, 1132 and 1133, a bit may have any number of blades, but generally will have no less than two blades separated by at least two fluid courses 1120. As the body portion 1134 of the blade 1132 radially extends outwardly from the axial center line 1161 of the bit 1110, the blade surface may radially widen, and the leading face 1138 and the trailing face 1139 may both axially increase in height above the face 1112 of the bit body 1111.

As previously stated, the drag bit 1110 of the invention includes three primary blades 1131, 1132, 1133 and three secondary or tertiary blades 1135, 1136, 1137. A secondary blade or a tertiary blade 1135, 1136, 1137 provides additional support structure in order to increase the cutter density of the bit 1110 by receiving additional primary cutters 1114 thereon. A secondary or a tertiary blade is defined much like a primary blade, but radially extends toward the gage region generally from a nose region 1162, a flank region 1163 or a shoulder region 1164 of the bit 1110. In this regard, a secondary blade or a tertiary blade 1135, 1136, 1137 is defined between leading and trailing fluid courses 1120 in fluid communication with at least one of the ports 1122. Also, a secondary blade or a tertiary blade, or a combination of secondary and tertiary blades may be provided between primary blades. However, the presence of secondary or tertiary blades decreases the available volume of the adjacent fluid courses 1120, providing less clearing action of the formation cuttings or cleaning of the cutters 1114. Optionally, a drag bit 1110 in accordance with an embodiment of the invention may include one or more secondary or tertiary blades when needed or desired to implement particular drilling characteristics of the drag bit.

Illustrated further on drag bit 1110 on blades 1131, 1132, 1133, 1135, 1136, 1137 are wear knots 1114' generally located in the shoulder region 1164, which protrude a predetermined distance from the surface of the blades 1131, 1132, 1133, 1135, 1136, 1137 depending upon the design of the drag bit 1110. As illustrated, each cutter 1114 is supported by a blade 1131, 1132, 1133, 1135, 1136, 1137 in which it is located having a portion of the leading faces 1138 of the blades 1131, 1132, 1133, 1135, 1136, 1137 covering a portion of the cutter 1114 to reduce impact loading thereon to reduce fracturing, cracking, spalling, breaking, etc., of the PDC portion of the cutter 1114 as well as the backup thereto during drilling. The cutters 1114 are located in pockets 1116 in the blades 1131, 1132, 1133, 1135, 1136, 1137 aft of the leading faces 1138 of the blades so that the cutters 1114 have improved durability (lack of breakage) from vibration damage during drilling, loss of the cutter 1114 caused by hydraulic fluid erosion in and around the cutter pocket 1116 or body of the drag bit 1110 adjacent a cutter pocket 1116, and better cutting removal from a cutter 1114 across the drag bit 1110 into a junk slot 1126. By recessing a portion of the cutter 1114 in the pocket 1116 both a portion of the front and the back as well as the sides of the cutter 1114 is supported by the blade 1131, 1132, 1133, 1135, 1136, 1137. A cutter 1114 is recessed in a pocket 1116 approximately one-half or 50% of the diameter or size of the cutter, although the cutter 1114 may be recessed anywhere from 5% to 50% of the diameter or size thereof in the pocket 1116, for the material of a blade 1131, 1132, 1133, 1135, 1136, 1137 to support the diamond table of cutter 1114 in the cutter pocket 1116 to reduce fracturing, cracking, spalling, breaking, etc., of the PDC portion of the cutter 1114 as well as the substrate thereof during drilling. More specifically, cutters 1114 may at least have about 5% to about 50% of their respective cutting surfaces covered by material of the blade to which they are respectively secured. Further, due to the use of cutter backrake, a rotationally trailing portion of the cutter 1114 may be more completely recessed within the cutter pocket 1116 in a blade 1131, 1132, 1133, 1135, 1136, 1137 than a rotationally leading portion of the cutter 1114 and, further, the sides of a cutter may be recessed within the cutter pocket 1116 to different depths. Finally, it may be said that the cutter 1114 is substantially completely surrounded by material of the blade 1131, 1132, 1133, 1135, 1136, 1137 when recessed in the cutter pocket 1116 according to embodiments of the present invention.

Figure 5:
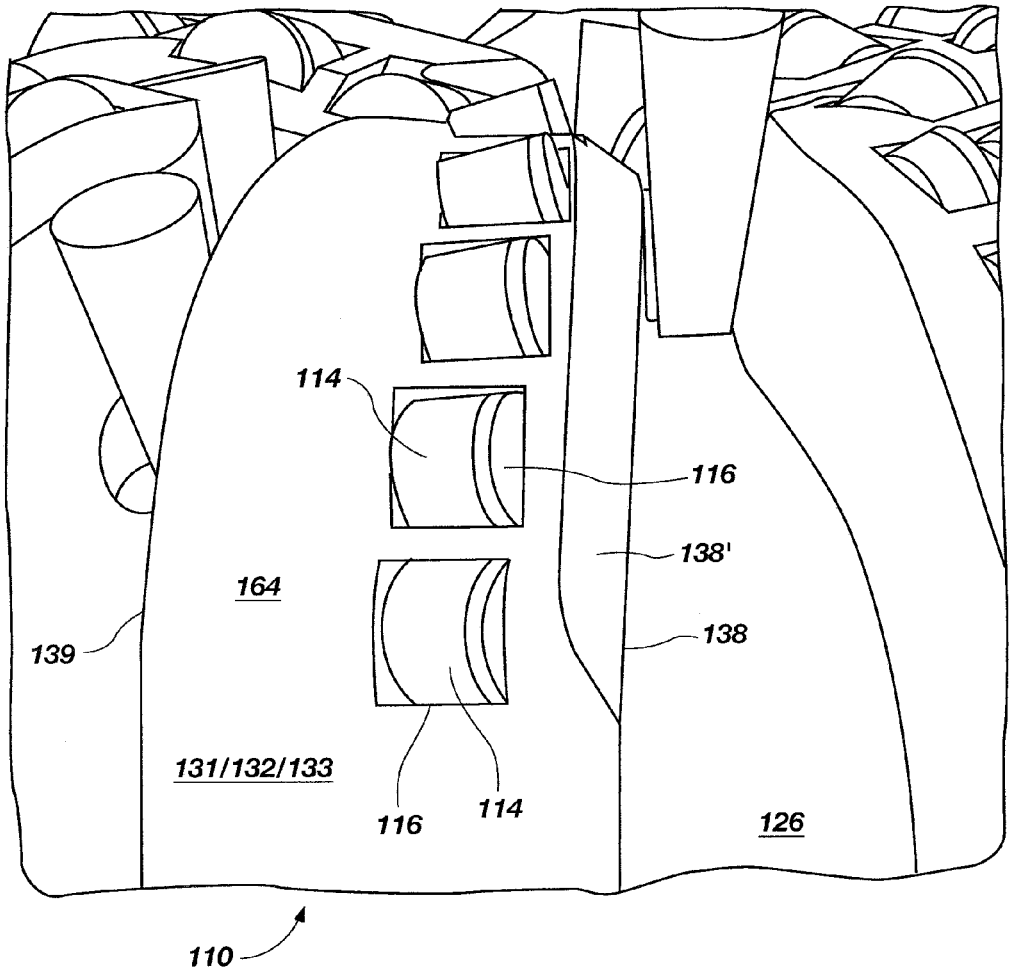
FIG. 5 shows a portion of a blade of another embodiment of a rotary drag bit herein.

Illustrated in FIG. 5 is a portion of a primary blade 131, 132, 133 having cutters 114 located in pockets 116 of the blade. The leading face 138 of the blade 131, 132, 133 includes a chamfered or angular portion 138' extending back from the vertical portion of the leading face 138. As illustrated, the pockets 116 are located aft of the leading face 138 so that a portion of the blade 131, 132, 133 provides support for the front of the cutter 114. Since the cutters 114 are secured in the pockets 116 by brazing, any space between the front, back, and sides of the cutter 114 and the walls forming the pocket 116 are filled with braze material to provide support for the cutter 114 in the pocket 116. While the cutters 114 have been illustrated having a backrake, the cutters 114 may have no backrake, a forward rake, or a backrake depending upon the design of the drag bit 110. The width of the blade 131, 132, 133, 135, 136, 137 of the drag bit 110 will vary so that the cutters 114 located in pockets 116 may be adequately supported on all sides in the drag bit 110.

Figure 6:
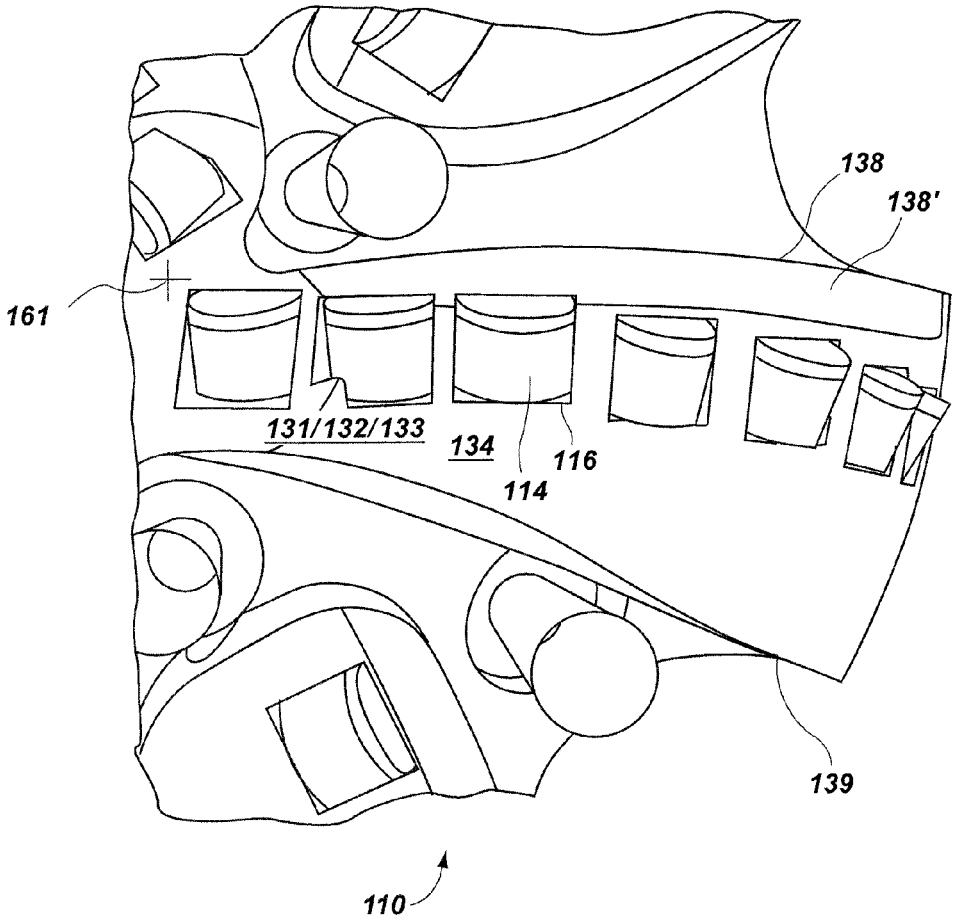
FIG. 6 shows a frontal or face view of a portion of a blade of another embodiment of a rotary drag bit herein.

Illustrated in FIG. 6 is a frontal or face view of a portion of rotary drag bit 110 of a primary blade 131, 132, 133 having cutters 114 in primary row 141, 142, 143 (see FIG. 1) located in pockets 116 therein as well as cutters 114 located in pockets 116 located in backup rows thereon. As illustrated, braze used to secure the cutters 114 in the pockets 116 is not shown for clarity. A suitable braze used to secure the cutters 114 in the pockets 116 is described in U.S. patent application Ser. No. 11/223,215, filed on Sep. 9, 2005, now U.S. Pat. No. 7,597,159, issued Oct. 6, 2009, which is incorporated in its entirety herein by reference.

Figure 7:
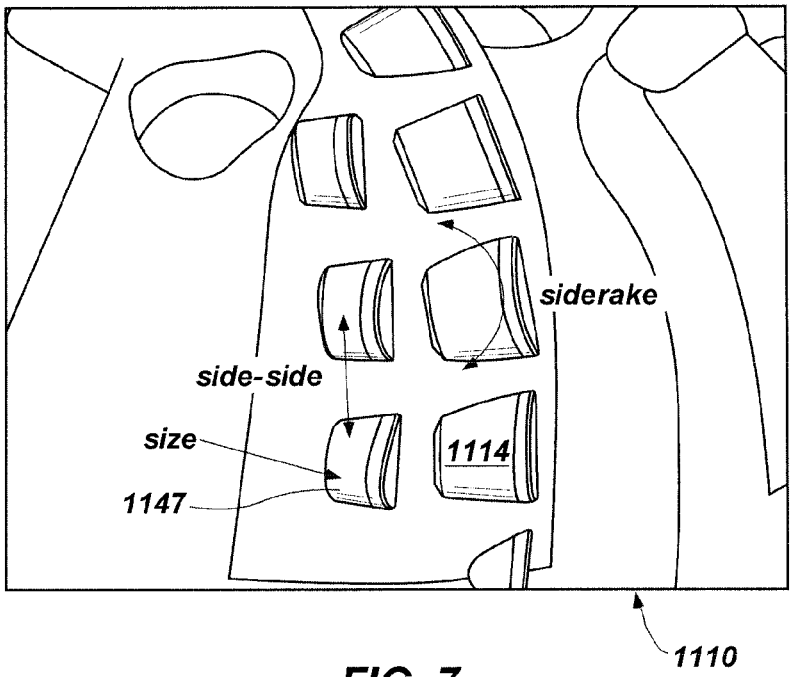
FIG. 7 shows a partial frontal or face view of an embodiment of a rotary drag bit similar to that of FIG. 4.
Figure 8:
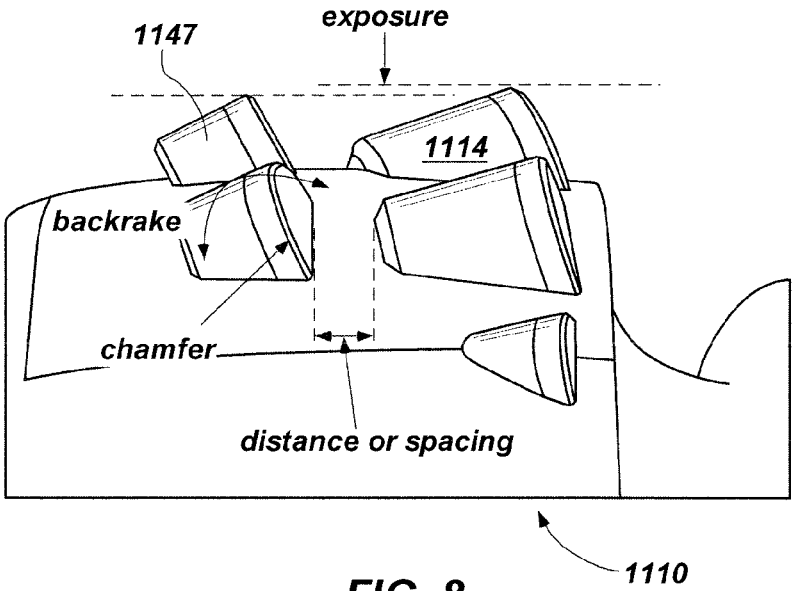
FIG. 8 shows a partial side view of the embodiment of a rotary drag bit of FIG. 4.

FIG. 7 shows a partial top view of a rotary drag bit 1110 showing the concept of cutter siderake (siderake), cutter placement (side-side), and cutter size (size). "Siderake" is described above. "Side-side" is the amount of distance between cutters in the same cutter row. "Size" is the cutter size, typically indicated in by the cutters' facial length or diameter. FIG. 8 shows a partial side view of the rotary drag bit 1110 of FIG. 7 showing concepts of backrake, exposure, chamfer and spacing as described herein.

In embodiments herein, one or more additional backup cutter rows may be included on a blade of a rotary drag bit rotationally following and in further addition to a primary cutter row and a backup cutter row. Each of the one or more additional backup cutter rows, the backup cutter row and the primary cutter row include one or more cutting elements or cutters on the same blade. Each of the cutters of the one or more additional backup cutter rows may align or substantially align in a concentrically rotational path with the cutters of the row that rotationally leads it. Optionally, each cutter may radially follow slightly off-center from the rotational path of the cutters located in the backup cutter row and the primary cutter row.

In embodiments herein, each additional backup cutter row may have a specific exposure with respect to a rotationally preceding cutter row on a blade of a drag bit. For example, each cutter row may incrementally step-down in values from a preceding cutter row, in this respect each cutter row is progressively underexposed with respect to a prior cutter row. Optionally, each subsequent cutter row may have an underexposure to a greater or lesser extent from the cutter row preceding it. By adjusting the amount of underexposure for the cutter rows, the cutters of the backup cutter rows may be engineered to come into contact with the material of the formation as the wear flat area of the primary cutters increases. In this respect, the cutters of the backup cutter rows are designed to engage the formation as the primary cutters wear in order to increase the life of the drag bit. Generally, a primary cutter is located typically on the front of a blade to provide the majority of the cutting work load, particularly when the cutters are less worn. As the primary cutters of the drag bit are subjected to dynamic dysfunctional energy or as the cutters wear, the backup cutters in the backup cutter rows begin to engage the formation and begin to take on or share the work from the primary cutters in order to better remove the material of the formation.

In embodiments herein, cutter groups may include cutter sets or cutter rows having different cutter sizes in order to improve, by reducing, the resistance experienced by a drag bit when a backup cutter follows a primary cutter. In this regard, a smaller backup cutter is better suited for following a primary cutter that is larger in diameter in order to provide a smooth concentric motion as a drag bit rotates. In one aspect, by decreasing the diameter size of each backup cutter from a ⅝ inch cutter diameter of the primary cutter to ½ inch, 11 millimeter, or ⅜ inch cutter, for example, without limitation, there is less interfering contact with the formation while removing material in a rotational path created by primary cutters. In another aspect, by providing backup cutters with a smaller cutter size, there is decreased formation contact with the non-cutting surfaces of the backup cutters, which improves the ROP of the drag bit.

In embodiments herein, a cutter of a backup cutter row may have a backrake angle that is more or less aggressive than a backrake angle of a cutter on a primary cutter row. Conventionally, in order to maintain the durability of a primary cutter a less aggressive backrake angle is utilized; while giving up cutter performance, the less aggressive backrake angle made the primary cutter more durable and less likely to chip when subjected to dysfunctional energy or string bounce. By providing backup cutters in embodiments herein, a more aggressive backrake angle may be utilized on the backup cutters, the primary cutters or on both. The combined cutters provide improved durability allowing the backrake angle to be aggressively selected in order to improve the overall performance of the cutters with less wear or chip potential caused by vibrational effects when drilling.

In embodiments herein, a cutter of a backup cutter row may have a chamfer that is more or less aggressive than a chamfer of a cutter on a primary cutter row. Conventionally, in order to maintain the durability of a primary cutter a longer chamfer was utilized, particularly when a more aggressive backrake angle was used on a primary cutter. While giving up cutter performance, the longer chamfer made the primary cutter more durable and less likely to fracture when subjected to dysfunctional energy while cutting. By providing backup cutters, a more aggressive, i.e., shorter, chamfer may be utilized on the backup cutters, the primary cutters or on both in order to increase the cutting rate of the bit. The combined cutters provide improved durability allowing the chamfer lengths to be more or less aggressive in order to improve the overall performance of the cutters with less fracture potential also caused by vibrational effects when drilling.

In embodiments herein, a drag bit may include a cutter coupled to a cutter pocket of a blade, the cutter having a siderake angle with respect to the rotational path of the cutter.

In embodiments herein, a cutting structure may be coupled to a blade of a drag bit, providing a larger diameter primary cutter placed at a front of the blade followed by one or more multiple rows of smaller diameter cutters either in substantially the same helical path or some other variation of cutter rotational tracking. The smaller diameter cutters, that rotationally follow the primary cutter, may be underexposed to different levels related to depth-of-cut or wear characteristics of the primary cutter so that the smaller cutters may engage the material of the formation at a specific depth of cut or after some worn state is achieved on the primary cutter. Depth of cut control features as described in U.S. Pat. No. 7,096,978 entitled "Drill bits with reduced exposure of cutters," the disclosure of which is incorporated herein by this reference, may be utilized in embodiments of the invention.

While particular embodiments herein have been shown and described, numerous variations and alternative embodiments will occur to those skilled in the art. Accordingly, it is intended that the invention be limited only in terms of the appended claims and their legal equivalents.

What is claimed is:

1. A rotary drag bit, comprising:

a bit body with a face and an axis;

at least one blade having a leading face and a trailing face, the at least one blade extending longitudinally and radially outward over the face of the bit body; and a primary cutter row comprising at least one primary cutter brazed to the respective at least one blade, the at least one primary cutter including a PDC diamond table bonded to a supporting substrate, the primary cutter row being the closest row to the leading face, the at least one primary cutter protruding only partially from the at least one blade and located to traverse a cutting path upon rotation of the bit body about the axis to engage a formation upon movement along the cutting path, wherein a portion of the cutting surface is abutted and supported by at least one of the portion of the at least one blade and a braze material disposed between the cutting surface and the portion of the at least one blade, wherein the at least one primary cutter is disposed within a preformed pocket of the blade, wherein the pocket is formed in and surrounded about an entire periphery of the pocket by a continuous surface of the at least one blade extending between the leading face of the at least one blade and the trailing face of the at least one blade, wherein a portion of the continuous surface extends between the cutting surface of the at least one primary cutter and the leading face of the at least one blade, and wherein the continuous surface extends along substantially a same profile from the leading face to the trailing face of the at least one blade, the profile being at least substantially linear, and wherein the entire periphery of the pocket extends along the profile of the continuous surface.

2. The rotary drag bit of claim 1, wherein the at least one blade comprises a primary blade.

3. The rotary drag bit of claim 1, wherein the at least one blade comprises a secondary blade.

4. The rotary drag bit of claim 1, further comprising at least one trailing backup cutter having a portion of a cutting surface thereof covered by a portion of the at least one blade.

5. The rotary drag bit of claim 1, wherein the at least one primary cutter has the cutting surface thereof covered by a portion of the at least one blade in the range of about 5% to about 50% of one of the diameter or size of the cutting surface of the at least one primary cutter.

6. The rotary drag bit of claim 4, wherein the at least one trailing backup cutter has the cutting surface thereof covered by a portion of the at least one blade in the range of about 5% to about 50% of one of the diameter or size of the cutting surface of the at least one trailing backup cutter.

7. The rotary drag bit of claim 4, wherein the rotary drag bit includes a plurality of primary blades, each primary blade including at least one primary cutter and at least one trailing backup cutter thereon.

8. The rotary drag bit of claim 1, wherein the at least one blade comprises a plurality of primary blades, and the rotary drag bit further includes a plurality of secondary blades, each secondary blade including at least one primary cutter and at least one trailing backup cutter thereon.

9. The rotary drag bit of claim 8, wherein at least some of the primary cutters have a cutting surface thereof covered by a portion of the at least one blade in the range of about 5% to about 50% of one of the diameter or size of the cutting surface of the at least one primary cutter.

10. The rotary drag bit of claim 9, wherein at least some of the trailing backup cutters have a cutting surface thereof covered by a portion of the at least one blade in the range of about 5% to about 50% of one of the diameter or size of the cutting surface of the at least one trailing backup cutter.

11. The rotary drag bit of claim 1, wherein the at least one blade includes a wear knot located thereon.

12. The rotary drag bit of claim 4, wherein the at least one trailing backup cutter is smaller than the at least one primary cutter.

13. The rotary drag bit of claim 4, wherein the at least one primary cutter and the at least one trailing backup cutter are the same size.

14. The rotary drag bit of claim 4, wherein the at least one primary cutter and the at least one trailing backup cutter comprise PDC cutters.

15. A rotary drag bit, comprising:

a bit body with a face and an axis;

at least one blade having a leading face and a trailing face, the at least one blade extending longitudinally and radially outward over the face of the bit body;

a primary cutter row comprising at least one primary cutter including a PDC diamond table bonded to a supporting substrate, the primary cutter row being the closest row to the leading face, the at least one primary cutter protruding only partially from the at least one blade and located to traverse a cutting path upon rotation of the bit body about the axis to engage a formation upon movement along the cutting path, wherein the at least one primary cutter is disposed partially within a preformed pocket of the at least one blade, wherein a braze material is disposed between and in contact with one or more walls of the pocket and at least the portion of the cutting surface covered by the portion of the at least one blade, wherein the pocket is formed in a continuous surface extending between the leading face of the at least one blade and the trailing face of the at least one blade, wherein at least a portion of the continuous surface is located between the cutting surface of the at least one primary cutter and the leading face of the at least one blade, and wherein the continuous surface extends along substantially a same profile from the leading face to the trailing face of the at least one blade, the profile being at least substantially linear, and wherein the entire periphery of the pocket extends along the profile of the continuous surface; and a backup cutter row comprising at least one trailing backup cutter, the at least one trailing backup cutter including a cutting surface protruding from the at least one blade located to traverse a cutting path upon rotation of the bit body about the axis to engage a formation upon movement along the cutting path.

16. The rotary drag bit of claim 15, wherein the at least one blade comprises a primary blade.

17. The rotary drag bit of claim 15, wherein the at least one blade comprises a secondary blade.

18. The rotary drag bit of claim 15, wherein the at least one trailing backup cutter has a portion of the cutting surface covered by a portion of the at least one blade.

19. The rotary drag bit of claim 15, wherein the at least one primary cutter has the cutting surface thereof covered by a portion of the at least one blade in the range of about 5% to about 50% of one of the diameter or size of the cutting surface of the at least one primary cutter.

20. The rotary drag bit of claim 15, wherein the at least one trailing backup cutter has the cutting surface thereof covered by a portion of the at least one blade in the range of about 5% to about 50% of one of the diameter or size of the cutting surface of the at least one trailing backup cutter.

21. The rotary drag bit of claim 15, wherein the at least one blade comprises a plurality of primary blades, each primary blade of the plurality of primary blades including at least one primary cutter and at least one trailing backup cutter thereon.

22. The rotary drag bit of claim 15, wherein the at least one blade comprises a plurality of secondary blades, each secondary blade of the plurality of secondary blades including at least one primary cutter and at least one trailing backup cutter thereon.

23. The rotary drag bit of claim 15, wherein the at least one trailing backup cutter is smaller than the at least one primary cutter.

24. The rotary drag bit of claim 15, wherein the at least one primary cutter and the at least one trailing backup cutter are the same size.

25. A rotary drag bit, comprising:

a bit body with a face and an axis;

at least one blade having a leading face and a trailing face, the at least one blade extending longitudinally and radially outward from the face of the bit body; and a primary cutter row comprising at least one primary cutter brazed to the respective at least one blade, the at least one primary cutter including a PDC diamond table, a supporting substrate, and a leading face having a portion thereof covered by a portion of the at least one blade, the primary cutter row being the closest row to the leading face, the at least one primary cutter protruding only partially from the at least one blade and located to traverse a cutting path upon rotation of the bit body about the axis to engage a formation upon movement along the cutting path, wherein the at least one primary cutter has the leading face thereof covered by a portion of the at least one blade in the range of about 5% to about 50% of one of the diameter or size of the leading face of the at least one primary cutter, wherein the leading face of the at least one primary cutter covered by the portion of the at least one blade is in direct contact with at least one of the portion of the at least one blade and a braze material disposed between the leading face of the at least one primary cutter and the portion of the at least one blade, wherein the at least one primary cutter is disposed within a preformed pocket of the at least one blade, wherein the preformed pocket is formed in and surrounded about an entire periphery of the pocket by a continuous surface of the at least one blade extending between the leading face of the at least one blade and the trailing face of the at least one blade, and wherein the continuous surface extends along substantially a same profile from the leading face to the trailing face of the at least one blade, the profile being at least substantially linear, and wherein the entire periphery of the pocket extends along the profile of the continuous surface.

* * * * *